United States Patent [19]

Portmann et al.

[11] 4,024,678

[45] May 24, 1977

[54] CONTROL AND CORRECTION CIRCUIT FOR AN ELECTRONIC WATCH

[75] Inventors: Hubert Portmann, Colombier; Willy Droz, Hauterive; Jean-Luc Beguin, Neuchatel, all of Switzerland

[73] Assignee: Ebauches S.A., Neuchatel, Switzerland

[22] Filed: Dec. 10, 1975

[21] Appl. No.: 639,416

[30] Foreign Application Priority Data

Jan. 10, 1975 Switzerland ..... 278/75

[52] U.S. Cl. ..... 58/23 R; 58/85.5

[51] Int. Cl.[2] ..... G04C 3/00; G04B 27/00

[58] Field of Search ..... 58/4 A, 39.5, 50 R, 58/58, 23 R, 85.5

[56] References Cited

UNITED STATES PATENTS 3,765,163 10/1973 Levin et al. ..... 58/50 R 3,800,525 4/1974 Bergey ..... 58/85.5

*Primary Examiner*—E. S. Jackmon

*Attorney, Agent, or Firm*—Imirie, Smiley & Linn

[57] ABSTRACT

A control and correction circuit for an electronic watch involving three push-buttons which are actuable to select and/or correct the information displayed by the watch. The push-buttons provide actuating signals to a delay device and to logic selection circuits which provide outputs to control the counters of the watch circuit. The delay device enables a secondary display to be displayed for a predetermined time after which the device returns to its initial state. During the predetermined time the information displayed may be corrected by actuation of the second or third push-button in which case the secondary display is held unitl the correction operation is complete before returning to its initial condition.

3 Claims, 3 Drawing Figures

CONTROL AND CORRECTION CIRCUIT FOR AN ELECTRONIC WATCH

BACKGROUND OF THE INVENTION

Several control and correction devices are known which provide for various combinations of input data, each combination causing a predetermined operation. With two push-buttons A and B, for example, four functions can be defined:

- Button A not pressed, button B not pressed: normal working
- Button A not pressed, button B pressed: hour correction
- Button A pressed, button B not pressed: minute correction
- Button A pressed, button B pressed: stopping of the watch.

It can be seen that if one wants to avoid a relatively complicated operation which involves pressing on several buttons at the same time, it is either necessary to multiply the number of push-buttons or provide a mechanical selector having several positions. For example, a crown can be provided which can have three angular positions and two axial positions (pulled or not pulled) which define in combination six different positions. Mechanically however, it is not very advantageous to have a great number of buttons nor a mechanical selector.

A known apparatus involves a sequential function selection device: the reaction caused by the action on the push-button does not depend on the combination of the momentary positions of the buttons but their history. If there are two push-buttons A and B and from one state where the watch functions normally, one presses one time on the button B, the sequential circuit will be in a state where one can correct, for example the hours, by pressing on the button A; a second depression of the button B will permit the correction, by pressing on Button A, of the minutes, and similarly continuing up to the point where one returns to a normal functioning position. The state in which the sequential device is found depends thus on the number of times the user has pressed on the button B: the difficulty resides here in the fact that, the selection being electronic, it is necessary that in one way or another the user can identify the different states of the circuit.

The object of the invention is to provide a control and correction device which is mechanically simple and the manipulation of which presents the least possible difficulty for the user.

SUMMARY OF THE INVENTION

The device in accordance with the invention comprises a control and correction device for an electronic watch having a four digit display indicating, during normal operation, two items of information, three push-buttons, two of which are for correction of the information display, a first push-button enables the display of two further items of information by activating a delay means, which upon release of the first push-button initiates the delay and returns the display to its initial state after a predetermined time, the second and third push-buttons permit correction of the information displayed by switching their corresponding counters, a pressure on the second and third push-buttons reactivate the delay means in a manner to permit a modification of the information display without the device returning to the initial state during the correction.

BRIEF DESCRIPTION OF THE DRAWINGS

The present invention will be described, by way of example, with reference to the accompanying drawings, in which.

DETAILED DESCRIPTION OF THE DRAWINGS

Figure 1:
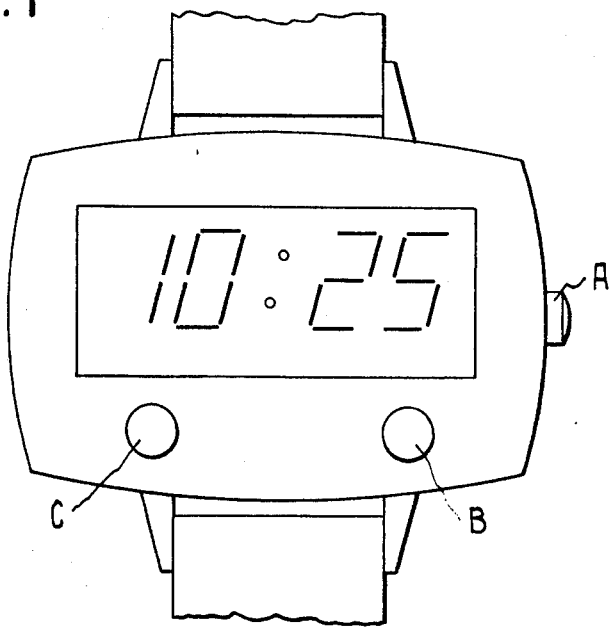
FIGS. 1 and 2 show the external configuration of a watch provided with a device in accordance with the present invention.

FIG. 1 shows the external appearance of a watch having a digital display. Four, seven segment display means are provided, in pairs, by means of which in normal working, the watch shows, by the left-hand pair of digits, the hours (in our example 10 hours) and by the right-hand pair of digits, the minutes (in our example 25 minutes). On the side of the watch a push-button A is provided and, below each pair of digits, push-buttons B and C are provided.

Figure 2:
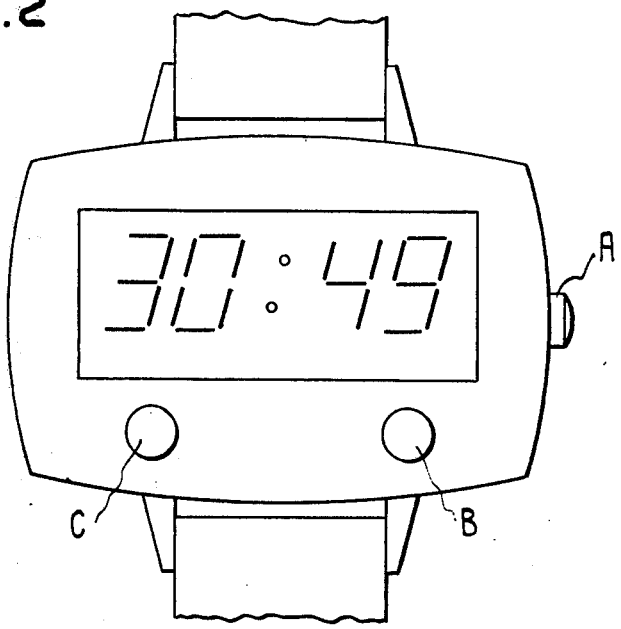

As will be described later, depression of the push-button A causes a secondary display, i.e. on the left the date, on the right the seconds (FIG. 2). This display persists for several seconds after the push-button A has been released, after which the watch returns to its normal working condition displaying the hour and the minute. The push-buttons B and C permit the correction of the date and time shown by the display. The button C corrects the hours if A is not depressed, and the date if A has been depressed, and the buttons B corrects the minutes if A is not depressed, and the seconds if A has been depressed.

Figure 3:
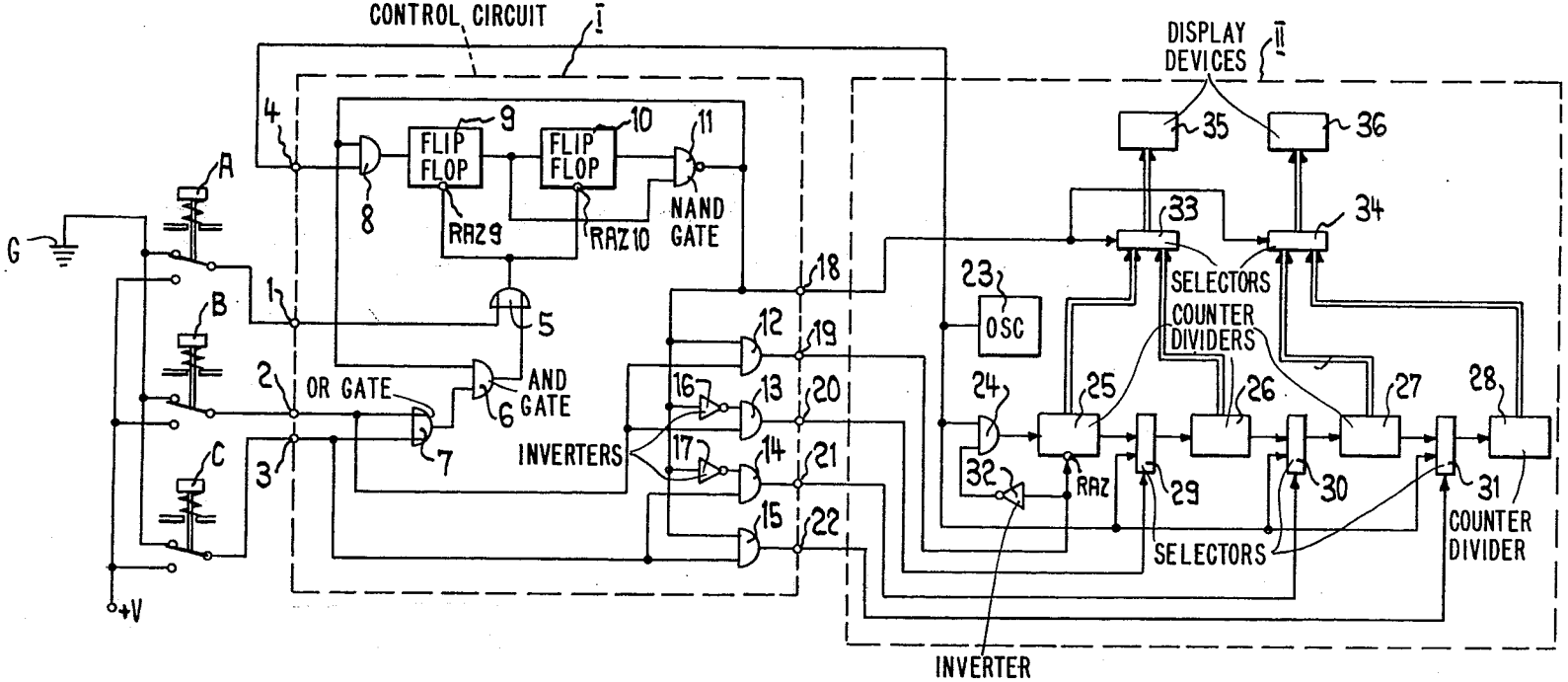
FIG. 3 illustrates one embodiment of a device in accordance with the invention in a circuit of an electronic watch.

FIG. 3 shows a control circuit I in accordance with the invention associated with a known type of watch circuit II. The control circuit I has three inputs 1, 2 and 3 associated with switches operated by push-buttons A, B and C. These switches are such that if the associated push-button is at rest, the corresponding input will be at a logic potential 0 because it is connected to earth G. If on the other hand one of the push-buttons is depressed, the corresponding input will have a logic potential 1 because it is now connected to a source of voltage +V. The input 2 of the control circuit is connected to one of the inputs of an OR gate 7 and also to AND gates 12 and 13, whilst the input 3 is connected to the other input of the OR gate 7 and to the inputs of the AND gates 14 and 15. The input 1 of the control circuit is connected to one of the inputs of an OR gate 5. The output of the OR gate 7 is connected to one of the inputs of an AND gate 6, the output of which is connected to the second input of the OR gate 5. A fourth input 4 of the control circuit I is supplied with clock impulses at a frequency of 1 Hz, for example, which clock impulses are fed via an AND gate 8 to a first flip-flop circuit 9. The flip-flop 9 is connected to a second flip-flop circuit 10. The outputs of these flip-flops are connected to the inputs of a NAND gate 11 the output of which provides a first output 18 of the control circuit I. This output 11 controls the opening or closing of the AND gates 6, 8, 12 and 15 to which it is directly connected. Output 11 is also connected to the AND gates 13 and 14 but via inverters 16 and 17. The output of the AND gates 12 to 15 form the outputs 19 to 22 of the control circuit I. The output of the OR gate 5 is connected to the rest inputs RAZ 9 and RAZ 10 of the flip-flop circuits 9 and 10.

When all the push-buttons are at rest, the outputs of the two flip-flop circuits 9 and 10 are at a logic potential 1 and the NAND gate 11 is at a logic potential 0 at its output. The state of the outlets 18 to 22 of the control circuit will be:

00000

If the push-button B is depressed, the AND gate 13 is open, and the outputs 18 to 22 of the control circuit are in the state:

00100

When the button B is released, the circuit returns to its previous state.

If the push-button C is depressed, the AND gate 14 is open so that the outputs will be in the state:

00010

By releasing the button C, the circuit is caused to return to its initial state.

If, from this initial state, the push-button is depressed then the two flip-flop circuits 9 and 10 will be returned to zero. by the OR gate 5, the NAND gate 11 will have a logic potential 1 at its output which opens the AND gates 6, 8, 12 and 15 and closes the AND gates 13 and 14. At this stage, the outputs 18 to 22 of the control circuit are in the state:

10000

As long as the button A is depressed, this state is maintained. When the button A is released, the impulses arriving at the input 4 of the control circuit I pass the AND gate 8 and cause the flip-flop circuits 9 and 10 to operate, freed of their reset signals. The logic potential 1 at the output of the NAND gate 11 will remain until the outputs of the flip-flop circuits 9 and 10 are both at a logic potential 1. At this moment, the control circuit will then return to its initial state. In our example, the time lapse which occurs between the moment when the button A is released and the moment where the circuit returns to its initial state, will be 2 to 3 seconds.

If, during this time lapse, the button B is depressed, then a reset signal is provided via the AND gate 6 and the OR gate 5 to the flip-flop circuits 9 and 10, which maintains the logic potential 1 at the outlet of the NAND gate 11. At the same time, the AND gate 12 provides a logic potential 1 at the outlet 19 of the control circuit, the output of this circuit have the state:

11000

This state is maintained as long as the button B is depressed.

If, before the control circuit returns to its initial state, instead of depressing the button B the button C is depressed, to the flip-flop circuits 9 and 10 will receive a reset signal, which maintains the logic potential 1 at the outlet 18 of the circuit. At the same time, a logic potential 1 will be provided at the output 22 of the AND gate 15. We will then have at the output of the control circuit a condition:

10001

This state is maintained as long as the button C is depressed.

In a general, the potential 1 at the output 18 of the control circuit will remain for 2 or 3 seconds after the particular button which was depressed has been released.

The outputs 18 to 22 of the control circuit can be used with a conventional watch circuit as is illustrated for example in the diagram II of FIG. 3.

In this circuit the counting chain comprises an oscillator 23 giving impulses of a frequency of 1 Hz, followed by a series of counter-dividers 25 to 28 between which are connected selectors 29 to 31. An AND gate 24 permits interruptions of the impulse train feeding the divider chain. The selectors 29 to 31 permit the feeding of the counter-dividers 26 to 28 either with the impulses provided by the preceding counter-divider, or with the impulses provided directly by the oscillator 23. The selectors 33 and 34 permit feeding the display devices 35 and 36 either with the contents of the counters 26 and 27 (minute and hour), or with the contents of the counters 25 and 28 (seconds and date). If the counters 26, 27 and 28 are to be corrected they are fed with impulses at a frequency of 1Hz. If the seconds counter 25 is to be corrected it will be reset by its input RAZ, which causes an interruption of the counting via an inverter 32 and the watch is thus stopped.

The table hereunder recalls the operation of the buttons, the corresponding of the output condition of the control device and the effects invoked by the control device in the watch:

| Manipulation: | State of the outputs 18 to 22: | Effect: |
|---|---|---|
| Button A pressed | 1 0 0 0 0 | Secondary display |
| Button B pressed[1] | 0 0 1 0 0 | Minute display correction |
| Button C pressed[1] | 0 0 0 1 0 | Hour display correction |
| Button B pressed[2] | 1 1 0 0 0 | Seconds return-to-zero |
| Button C pressed[2] | 1 0 0 0 1 | Date display correction |

Where the indices indicate
[1]After two seconds have elapsed after having released push-button A.
[2]Before two seconds have elapsed after having released push-button A.

We claim:

1. A control and correction device for an electronic watch comprising time counters and a four digit display indicating, during normal operation, two items of information from said counters, three push-buttons, two of which are for correction of the information display, a first push-button enables the display of two further items of information by activating a delay means which upon release of the first push-button initiates the delay and returns the display to its initial state after a predetermined time, the second and third push buttons permit correction of the information displayed by switching their corresponding counters, a pressure on the second and third push-buttons within said predetermined time after activation of said first pushbutton resetting the delay means in a manner to permit a modification of the information display without the device returning to the initial state during the correction.

2. A device in accordance with claim 1, in which the delay means is a counter comprising two flip-flops, the outputs of which feed NAND gate, the said counter is supplied with impulses derived from the watch circuit via an AND gate which can be closed by the output signal of the said NAND gate, and being capable of actuation by a signal derived from the first push-button on the resetting inputs of the flip-flop.

3. A device in accordance with claim 1, in which the signals provided by the second and third push-buttons are supplied to an OR gate, then to an AND gate which may be closed by the output signal of the delay means and the second and third push-buttons also feed two AND gates, one at least of which is opened by the output signal of the delay means.

* * * * *